US006213165B1

(12) United States Patent
Guida et al.

(10) Patent No.: US 6,213,165 B1
(45) Date of Patent: Apr. 10, 2001

(54) METHOD FOR FILLING AN ELECTRICAL DEVICE FOR MEDIUM AND HIGH VOLTAGE APPLICATIONS

(75) Inventors: Cesare Guida, Milan; Manuela Signorelli, Osio Sotto; Mario Pregnolato, Rivoli; Andrea Catenacci, Milan, all of (IT)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/471,086

(22) Filed: Dec. 23, 1999

(30) Foreign Application Priority Data

Dec. 23, 1998 (EP) ..... 98204361

(51) Int. Cl.[7] ..... H01B 17/32
(52) U.S. Cl. ..... 141/9; 141/5; 141/7
(58) Field of Search ..... 141/1, 4, 5, 7–9

(56) References Cited

U.S. PATENT DOCUMENTS 4,051,920 * 10/1977 Reinsma ..... 184/1 R
4,408,640 * 10/1983 Voza ..... 141/1
4,622,250 11/1986 Chabala et al. ..... 428/35
4,928,376 * 5/1990 Poglitsch ..... 141/5
5,024,255 * 6/1991 Watanabe et al. ..... 141/4
5,171,769 * 12/1992 Bull et al. ..... 523/447
5,246,042 * 9/1993 Farrell ..... 141/59
5,406,989 * 4/1995 Abe ..... 141/7
5,837,739 * 11/1998 Nowak et al. ..... 521/54
5,902,849 * 5/1999 Heucher et al. ..... 524/484

FOREIGN PATENT DOCUMENTS 3419586 11/1985 (DE) .

* cited by examiner

*Primary Examiner*—J. Casimer Jacyna
(74) *Attorney, Agent, or Firm*—Oblon, Spivak, McClelland, Maier & Neustadt, P.C.

(57) ABSTRACT

A method for filling an electrical device with a multi-component insulating filler, including the steps of: mixing at least two components of insulating filler each with compressible microspheres; measuring at regular intervals a viscosity of each of the at least two components of insulating filler mixed with the microspheres until each of the at least two components of insulating filler have a substantially uniform viscosity; mixing the at least two components of insulating filler together in order to obtain a multi-component insulating filler; extracting air present in a free volume V of the electrical device using a vacuum pump; filling the free volume V of the electrical device with the multi-component insulating filler until the free volume V of the electrical device is completely filled; and injecting an additional amount of the multi-component insulating filler in order to develop overpressure.

9 Claims, 1 Drawing Sheet

METHOD FOR FILLING AN ELECTRICAL DEVICE FOR MEDIUM AND HIGH VOLTAGE APPLICATIONS

CROSS-REFERENCE TO RELATED APPLICATIONS

This application claims benefit of priority under 35 U.S.C. §119(a) from European Application No. EP 98204361.4 filed Dec. 23, 1998, the entire contents of which are incorporated by reference herein.

BACKGROUND OF THE INVENTION

1. Field of the Invention

The present invention relates generally to a method for filling an electrical device using insulating filler and more particularly to a method for filling an electrical device for medium and high voltage applications, i.e. electrical devices having voltages greater than 1000V, using a multi-component insulating filler.

2. Description of the Related Art

Electrical devices for medium and high voltage applications, in particular for transmission and/or distribution lines, such as circuit breakers, power transformers and measuring transformers, insulated switch-gears, surge arresters, cable terminations, pole heads, bushings, and insulators include free volumes that are designed to be filled with insulating materials. These insulating filler materials, which can be solid, semi-solid, liquid or gaseous materials, primarily function to guarantee the dielectric strength among the parts of the device having different voltages in the presence of electrical stresses due to the normal functioning of the device itself.

Dielectric oils are one example of liquid insulating fillers that are not entirely satisfactory for this purpose for various reasons. For example, they require the use of compensating volumes to cope with any expansion of the insulating oil following changes in temperature.

In the case of gaseous insulating fillers, such as sulphur hexafluoride (SF6) or nitrogen and/or related mixtures, it is necessary to use gas pressure monitoring devices as well as gas filling devices in order to keep the dielectric oil's insulating capacities unchanged. Moreover, in both the case of gaseous and liquid fillers, it is necessary to adopt special measures and to equip the electrical devices with safety systems in order to avoid and/or indicate filler leakages and discharges. Leakages and consequent discharges of the dielectric filler can not only lead to malfunctioning of the electrical device but to environmental pollution problems as well. Gaseous insulating fillers clearly affect the electrical devices in terms of structural complexity and the overall reliability of the insulation system.

In some applications single component or multi-component solid or semi-solid materials are used as insulating fillers, for example polyurethane, silicone foams or rubbers, silicone gels or polyurethane gels etcetera. Although these solid or semi-solid fillers make it possible to overcome the aforementioned drawbacks due to their intrinsic properties, they require special attention during installation in order to achieve optimal insulating performance. A typical drawback of solid or semi-solid fillers resides in the fact that they require accurate controls to verify that there is good adhesion between the walls of the electrical device and the filler itself. Indeed, in case of defective and non-homogeneous adhesion to the walls of the device, destructive electric discharges may generate due to air filtering. These electric discharges could cause the electric device to breakdown.

One of the solutions adopted to overcome this problem is to treat the surfaces of the electrical device with primers in order to facilitate good and homogeneous adhesion between the walls and the filler. Such treatments are expensive and complicated especially in the case of electric devices having complex geometry and in particular when functional elements such as cables, mechanical rods, and connections subject to voltage are present inside them.

Another problem related in particular to the use of solid insulating fillers is the fact that they generally have high thermal expansion coefficients associated with a reduced ability to insulate. These properties make these materials extremely sensitive to thermal changes and, if special measures are not adopted, limit their use to thermally stable environments. For example, cross-linked silicone elastomers can be used as insulating fillers for electrical applications. These materials have a very high thermal expansion coefficient (about $10^3$ $C^{-1}$) and a very low compressibility, comparable to the compressibility of liquids. In application, because the silicone elastomer is contained in enclosed spaces and subject to dilation caused by possible heating, damage to the electrical device can occur.

In the specific case of semi-solid insulating fillers (e.g., silicone gels or polyurethane gels) since these materials are generally made up of two or more components that have different chemical-physical characteristics from one another, the filling method demands particular care both during preparation of the filler and while the filler is being injected into the device. In particular, in order to obtain a final product that fully satisfies performance requirements, it is necessary to homogenize and mix the components forming the filler correctly. If this is not done, unsatisfactory polymerization of the material may result inside the device resulting in negative consequences for the dielectric strength of the system. Moreover, unlike other filler materials, such as foams or resins, gels are semi-solid materials that behave like a highly viscous material before polymerization and like a viscoelastic rubber material thereafter. This makes it necessary to use special injection devices.

Moreover, the fact that the filling method must ensure that the filler fills up all the spaces available and adheres to the walls of the device without performing any surface treatments should not be undervalued. Further measures need to be adopted in order to satisfy these conditions, since gels are mechanically weak materials that nevertheless have low fluidity.

SUMMARY OF THE INVENTION

Accordingly, one object of the invention is to provide a method for filling an electrical device for medium and high voltage applications in which the filler is inserted in the device in a simple and effective manner, ensuring in particular that the filler fills all free spaces.

Yet another object of the present invention is to provide a method for filling an electrical device for medium and high voltage applications in which the injection of the filler is carried out in such a way as to ensure optimal adhesion between the filler and the walls of the device along all of the contact surfaces without the need for surface treatments or the use of primers.

Still yet another object of the present invention is to provide a method for filling an electrical device for medium and high voltage applications that is highly reliable and relatively easy to manufacture at competitive costs.

These objects and others are achieved according to the present invention by providing a novel method for filling an electrical device for medium and high voltage applications with a multi-component insulating filler, including the steps of: mixing at least two components, of insulating filler each with compressible microspheres; measuring at regular intervals a viscosity of each of the at least two components of insulating filler mixed with the microspheres until each of the at least two components of insulating filler have a substantially uniform viscosity; mixing the at least two components of insulating filler together in order to obtain a multi-component insulating filler; extracting air present in a free volume V of the electrical device using a vacuum pump; filling the free volume V of the electrical device with the multi-component insulating filler until the free volume V of the electrical device is completely filled; and injecting an additional amount of the multi-component insulating filler in order to develop overpressure.

The method according to the present invention therefore makes it possible to introduce a multi-component insulating filler into an electrical device in such a manner as to perfectly fill all the spaces available, perfectly eliminating the possibility of any air pockets. Moreover, the method facilitates optimal adhesion between the filler and surrounding walls without the need for special surface treatments and makes the insulating system resistant both to sudden temperature changes and any mechanical oscillations and deformation of the structure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
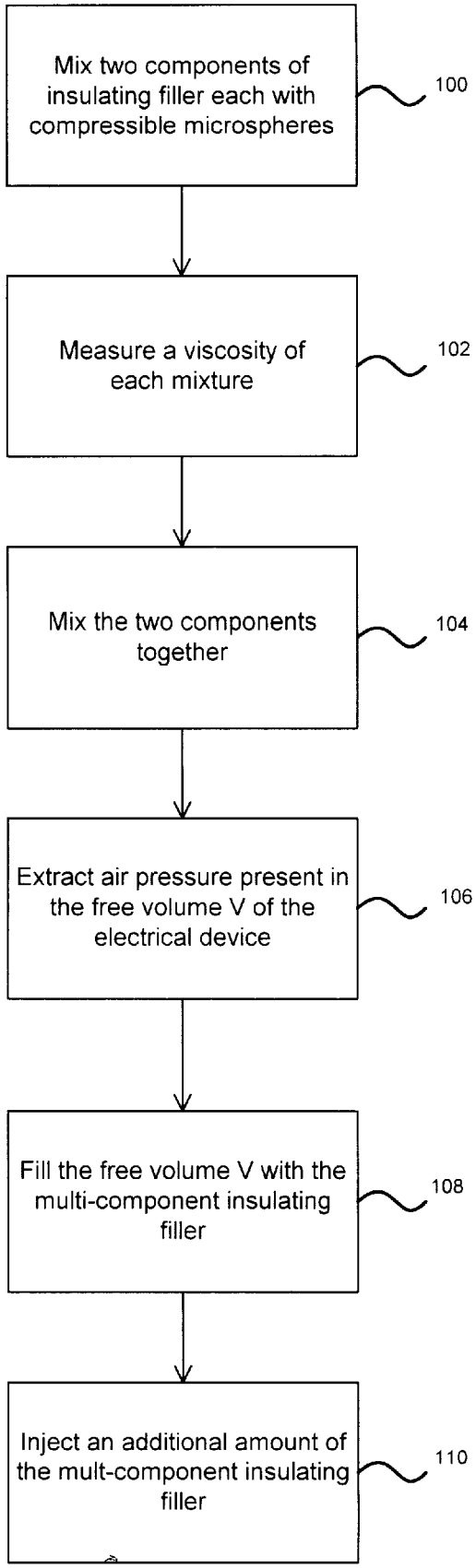
FIG. 1 is a flow chart illustrating the method steps of a preferred embodiment of the invention.

Referring now to the drawings, wherein like reference numerals designate identical or corresponding method steps, and more particularly to FIG. 1, a method according to the present invention will now be described with particular reference to the use of a two-component silicone gel as an insulating filler. An example of a gel of this type is described in European patent application No. 98202327.7, the description of which is herein incorporated by reference.

The two base components that form the silicone gel for the electrical device for high and medium voltage applications are initially in liquid form and are inserted separately in corresponding containers. In particular the device has a free volume V configured to be filled with the multi-component filler. Thus, in phase 100 the two components are mixed with hollow compressible microspheres. An example of microspheres that can be used are those commercially known as Dualite® manufactured by the Pierce and Stephens Corporation, or those commercially known as Expancel® manufactured by Akzo Nobel. Adding the microspheres makes it possible to give the filler qualities of compressibility for a purpose that shall emerge in greater detail hereinafter.

During phase 100 it is necessary to ensure optimal homogenization of the liquid component and microspheres so as to develop a gel having a satisfactory final quality. This homogenization can be obtained by using a suitable mechanical mixer, such as a perforated rotating blade immersed in the liquid. The action of the mixer can be effectively aided with a recirculating pump that extracts the component from the bottom of the container and returns it from the top surface. In this way it is possible to obtain a component having homogeneous characteristics throughout. Moreover, the continuous mixing action of the rotating blade and recirculating pump prevents demixing of the liquid component and microspheres.

During phase 102 the viscosity of each mixture is measured at several points at regular intervals. This phase includes taking a sample quantity of material from both the containers. The viscosity can be measured using traditional methods in accordance with that laid down by the international ASTM standards. It is possible, for example, to use a Ford cup due to its ease of application. Alternatively, it is possible to use office viscosimeters or other methods provided that they are, however, compatible with the application requirements.

When the viscosity of each component homogenized with the microspheres is substantially uniform, it is possible to mix the two components together during phase 104. If the mixing is carried out with components that do not have uniform viscosities, the resulting mixture will have a non-optimal reaction or, indeed, no reaction at all, resulting in a gel that is not suitable for the insulating requirements of the electrical devices. The two components are preferably mixed when they have the same or very similar viscosities.

Phase 104 can be realized using a screw pump that extracts the two components separately and sends them to a dynamic mixer. Using a dynamic mixer makes it possible to minimize load losses.

During phase 106, air present in free volume V is extracted using a vacuum pump in order to prevent the formation of air pockets inside the filler. The vacuum pump can also be used during the injection of the filler to aid the action of the injection pump.

The mixture still in a substantially liquid form, is injected with an injection pump into the free volume V of the electrical device during phase 108. In particular, the walls of the the crevice are cleaned in advance using suitable solvents to prevent any contamination of the filler and to facilitate its flow into the free volume V.

Preferably, when the free volume V has been totally filled with the insulating material, an extra quantity of filler is injected in order to develop overpressure during phase 110. The extra quantity of filler preferably comprises between 0.01 and 0.30 of the free volume V. The exerted pressure for this phase is between 1.1 bar and 15 bar, preferably between 4 and 12 bar, and with greater preference between 6 bar and 10 bar. The material injected in the free volume V polymerizes, passing from a liquid state to a semi-solid state typical of gels.

The added extra quantity of filler is made possible by the compressibility of the material, resulting from the presence of the microspheres, and facilitates perfect adhesion of the gel along all the contact surfaces. Moreover, since the volume of the gel is greater than the free volume V which can be occupied without overpressure, it is ensured that the gel occupies every available space. A further advantage lies in the fact that providing the filler with favorable qualities of compressibility renders it possible to compensate any thermal expansion with operating temperatures that can range from −40° C. to +70° C. without adopting additional compensation volumes, while also avoiding the detachment of the gel from the containing walls.

Alternatively, and in an equivalent manner, a two-component polyurethane gel can be used as a multi-component insulating filler.

As a consequence of its simplicity and effectiveness, the present invention can advantageously be used for a wide range of different electrical devices, such as circuit-breakers, power transformers and measuring transformers, insulated switch-gears, surge arresters, cable terminations, bushings, insulators and the like. More specifically, it is particularly suitable for filling a pole head for supporting an aerial transmission and/or distribution power line. In this case, the pole head comprises at least one tubular portion, for example made of an insulating composite material, preferably fiberglass, which is externally covered with insulating sheds, for example made of silicone rubber. The tubular portion can be formed by a single tube or by several tubular sections with a cylindrical or conical shape that is/are connected to one another by connecting flanges supporting the line's phase conductors. A total free volume V is formed inside the tubular portion that must be filled with insulating material suitable for ensuring the dielectric strength among the various parts of the pole head having different voltages. This volume V can be effectively filled using the method in the same way as described above.

It has in practice been observed that the present invention makes it possible to achieve the task and objects set forth herein in that it makes it possible to fill all the available spaces inside the electrical device in an optimal manner, while simultaneously ensuring good adhesion to the walls of the device itself. Amongst other things, the use of an insulating filler such as a gel in itself prevents the possibility of filler leakages and thus makes adoption of safety systems superfluous.

Obviously, numerous modifications and variations of the present invention are possible in light of the above teachings. For example, different multi-component insulating fillers may be provided that are compatible with the application. It is therefore to be understood that within the scope of the appended claims, the invention may be practiced otherwise than as specifically described herein.

What is claimed as new and desired to be secured by Letters Patent of the United States is:

1. A method for filling an electrical device with a multi-component insulating filler, comprising the steps of:

mixing at least two components of insulating filler each with compressible microspheres;

measuring at regular intervals a viscosity of each of said at least two components of insulating filler mixed with said microspheres until each of said at least two components of insulating filler have a substantially uniform viscosity;

mixing said at least two components of insulating filler together in order to obtain a multi-component insulating filler;

extracting air present in a free volume V of the electrical device using a vacuum pump;

filling the free volume V of the electrical device with the multi-component insulating filler until the free volume V of the electrical device is completely filled; and injecting an additional amount of the multi-component insulating filler in order to develop overpressure.

2. The method for filling an electrical device with a multi-component insulating filler according to claim 1, wherein said injecting step comprises:

injecting the multi-component insulating filler until a pressure between 1.1 bar and 15 bar is realized in the electrical device.

3. The method for filling an electrical device with a multi-component insulating filler according to claim 1, wherein said injecting step comprises:

injecting the multi-component insulating filler until a pressure between 4 bar and 12 bar is realized in the electrical device.

4. The method for filling an electrical device with a multi-component insulating filler according to claim 1, wherein said injecting step comprises the step of:

injecting the multi-component insulating filler until a pressure between 6 bar and 10 bar is realized in the electrical device.

5. The method for filling an electrical device with a multi-component insulating filler according to claim 1, wherein said mixing at least two components of insulating filler each with compressible microspheres step comprises the step of:

mixing two components of silicone gel each with compressible microspheres.

6. The method for filling an electrical device with a multi-component insulating filler according to claim 1, wherein said mixing at least two components of insulating filler each with compressible microspheres step comprises the step of:

mixing two components of polyurethane gel each with compressible microspheres.

7. The method for filling an electrical device with a multi-component insulating filler according to claim 1, wherein said injecting step comprises:

injecting additional amounts of the multi-component insulating filler equal to between one percent and thirty percent of the free volume V of the electrical device.

8. A method for filling a pole head for medium and high voltage transmission and/or distribution lines, said pole head including at least one tubular portion made of insulating composite material which is externally covered with insulating silicone and defines internally a free volume V designed to be filled with a multi-component insulating filler, wherein said method comprises the steps of:

mixing at least two components of insulating filler each with compressible microspheres;

measuring at regular intervals a viscosity of each of said at least two components of insulating filler mixed with said microspheres until each of said at least two components of insulating filler have a substantially uniform viscosity;

mixing said at least two components of insulating filler together in order to obtain a multi-component insulating filler;

extracting air present in a free volume V of the pole head using a vacuum pump;

filling the free volume V of the electrical device with the multi-component insulating filler until the free volume V of the pole head is completely filled; and injecting an additional amount of the multi-component insulating filler in order to develop overpressure.

9. An electrical device including a multi-component insulating filler prepared by a process comprising the steps of:

mixing at least two components of insulating filler each with compressible microspheres;

measuring at regular intervals a viscosity of each of said at least two components of insulating filler mixed with said microspheres until each of said at least two components of insulating filler have a substantially uniform viscosity;

mixing said at least two components of insulating filler together in order to obtain a multi-component insulating filler;

extracting air present in a free volume V of the electrical device using a vacuum pump;

filling the free volume V of the electrical device with the multi-component insulating filler until the free volume V of the electrical device is completely filled; and injecting an additional amount of the multi-component insulating filler in order to develop overpressure.

* * * * *